US011089667B2

(12) United States Patent
Hirayama et al.

(10) Patent No.: US 11,089,667 B2
(45) Date of Patent: Aug. 10, 2021

(54) X-RAY COMPUTED TOMOGRAPHY APPARATUS

(71) Applicant: CANON MEDICAL SYSTEMS CORPORATION, Otawara (JP)

(72) Inventors: Hiroshi Hirayama, Tokyo (JP); Sanae Harada, Nasushiobara (JP); Takenori Mizuno, Otawara (JP); Masahiro Karahashi, Otawara (JP)

(73) Assignee: CANON MEDICAL SYSTEMS CORPORATION, Otawara (JP)

( * ) Notice: Subject to any disclaimer, the term of this patent is extended or adjusted under 35 U.S.C. 154(b) by 0 days.

(21) Appl. No.: 16/842,925

(22) Filed: Apr. 8, 2020

(65) Prior Publication Data

US 2020/0245442 A1 Jul. 30, 2020

Related U.S. Application Data

(63) Continuation of application No. 15/888,219, filed on Feb. 5, 2018, now Pat. No. 10,660,190.

(30) Foreign Application Priority Data

Feb. 6, 2017 (JP) ..... JP2017-019391
Jan. 31, 2018 (JP) ..... JP2018-014906

(51) Int. Cl.
*H05G 1/32* (2006.01)
*H05G 1/10* (2006.01)
(Continued)

(52) U.S. Cl.
CPC ..... *H05G 1/32* (2013.01); *H01J 35/04* (2013.01); *H01J 35/06* (2013.01); *H01J 35/066* (2019.05);
(Continued)

(58) Field of Classification Search
CPC ..... H01J 35/04; H01J 35/06; H01J 35/08; H05G 1/10; H05G 1/32; H05G 1/38; H05G 1/58
See application file for complete search history.

(56) References Cited

U.S. PATENT DOCUMENTS 6,178,226 B1 1/2001 Hell
6,438,207 B1 8/2002 Chidester
(Continued)

FOREIGN PATENT DOCUMENTS

JP 11-502357 2/1999
JP 2003-163098 6/2003
(Continued)

*Primary Examiner* — Mark R Gaworecki
(74) *Attorney, Agent, or Firm* — Oblon, McClelland, Maier & Neustadt, L.L.P.

(57) ABSTRACT

According to one embodiment, an X-ray computed tomography apparatus includes an X-ray tube, a high voltage power supply, and focus size control circuitry. The X-ray tube includes a cathode, an anode, and a deflector configured to deflect the electrons from the cathode. The high voltage power supply generates a tube voltage to be applied between the cathode and the anode. The focus size control circuitry controls a focus size formed in the anode by applying to the deflector a deflecting voltage of a deflecting voltage value based on a tube voltage value of the tube voltage and a predetermined size, in order to form a focus of the predetermined size in the anode during the period where the tube voltage is applied by the high voltage power supply.

1 Claim, 4 Drawing Sheets

(51) Int. Cl.

| | |
|---|---|
| ***H01J 35/06*** | (2006.01) |
| ***H01J 35/08*** | (2006.01) |
| ***H01J 35/04*** | (2006.01) |
| ***H05G 1/58*** | (2006.01) |
| *H05G 1/38* | (2006.01) |

(52) U.S. Cl.
CPC ..... *H05G 1/10* (2013.01); *H05G 1/58* (2013.01); *H05G 1/38* (2013.01)

(56) References Cited

U.S. PATENT DOCUMENTS

| | | | |
|---|---|---|---|
| 2005/0163284 | A1 | 7/2005 | Inazuru |
| 2010/0303202 | A1 | 12/2010 | Ren |
| 2011/0080992 | A1 | 4/2011 | Dafni |
| 2011/0142204 | A1 | 6/2011 | Zou |
| 2011/0255667 | A1 | 10/2011 | Lemaitre |
| 2012/0269321 | A1 | 10/2012 | Behling |
| 2014/0185776 | A1 | 7/2014 | Li |
| 2017/0372863 | A1 | 12/2017 | Price |
| 2018/0082818 | A1 | 3/2018 | Meiler |

FOREIGN PATENT DOCUMENTS

| | | |
|---|---|---|
| JP | 2003-332098 | 11/2003 |
| JP | 2007-319575 | 12/2007 |
| WO | WO 96/24860 A1 | 8/1996 |

| Input value | | Set focus size [mm × mm] | | |
|---|---|---|---|---|
| Input tube voltage value [kV] | Input tube current value [mA] | L1 × W1 | · · · | L9 × W9 |
| V1 | A11 | BV111 | · · · | BV119 |
| | · · · | · · · | · · · | · · · |
| | A19 | BV191 | · · · | BV199 |
| V2 | A21 | BV211 | · · · | BV219 |
| | · · · | · · · | · · · | · · · |
| | A29 | BV291 | · · · | BV299 |
| V3 | A31 | BV311 | · · · | VB319 |
| | · · · | · · · | · · · | · · · |
| | A39 | BV391 | · · · | BV399 |

X-RAY COMPUTED TOMOGRAPHY APPARATUS

CROSS-REFERENCE TO RELATED APPLICATIONS

This application is a continuation of U.S. patent application Ser. No. 15/888,219, filed on Feb. 5, 2018, which is based upon and claims the benefit of priority from Japanese Patent Application No. 2017-19391, filed Feb. 6, 2017 and Japanese Patent Application No. 2018-14906, filed Jan. 31, 2018. The entire contents of those three applications are incorporated herein by reference.

FIELD

Embodiments described herein relate generally to an X-ray computed tomography apparatus.

BACKGROUND

In X-ray computed tomography apparatuses, tube voltage modulation has been demanded in order to reduce the exposure amount. If a tube voltage is simply modulated, the emission properties of a tube current change depending on the tube voltage, and accordingly, the tube current value and the focus size are changed as well.

To solve this problem, Jpn. Pat. Appln. KOKAI Publication No. 2003-163098, for example, discloses that the tube voltage is divided to generate a focus voltage, and the focus size is modulated by the generated focus voltage. Since the focus electrode retains the ground potential, and the tube voltage and the focus voltage have a proportional relationship, the focus size can be stably maintained even if a ripple occurs in the tube voltage.

However, if the tube voltage value significantly changes as occurs in tube voltage modulation, the proportional relationship between the tube voltage and the focus voltage may be deteriorated. Thus, it is difficult to discretionarily control the focus size while performing tube voltage modulation in the technique disclosed in Jpn. Pat. Appln. KOKAI Publication No. 2003-163098.

DETAILED DESCRIPTION

In general, according to one embodiment, an X-ray computed tomography apparatus includes an X-ray tube, a high voltage power supply, and focus size control circuitry. The X-ray tube includes a cathode configured to emit electrons, an anode configured to generate X-rays upon receiving the electrons from the cathode, and a deflector configured to deflect the electrons from the cathode. The high voltage power supply generates a tube voltage to be applied between the cathode and the anode. The focus size control circuitry controls a focus size formed in the anode by applying to the deflector a deflecting voltage of a deflecting voltage value based on a tube voltage value of the tube voltage and a predetermined size, in order to form a focus of the predetermined size in the anode during the period where the tube voltage is applied by the high voltage power supply.

In the following, the X-ray computed tomography apparatus according to the present embodiment will be explained with reference to the drawings.

Figure 1:
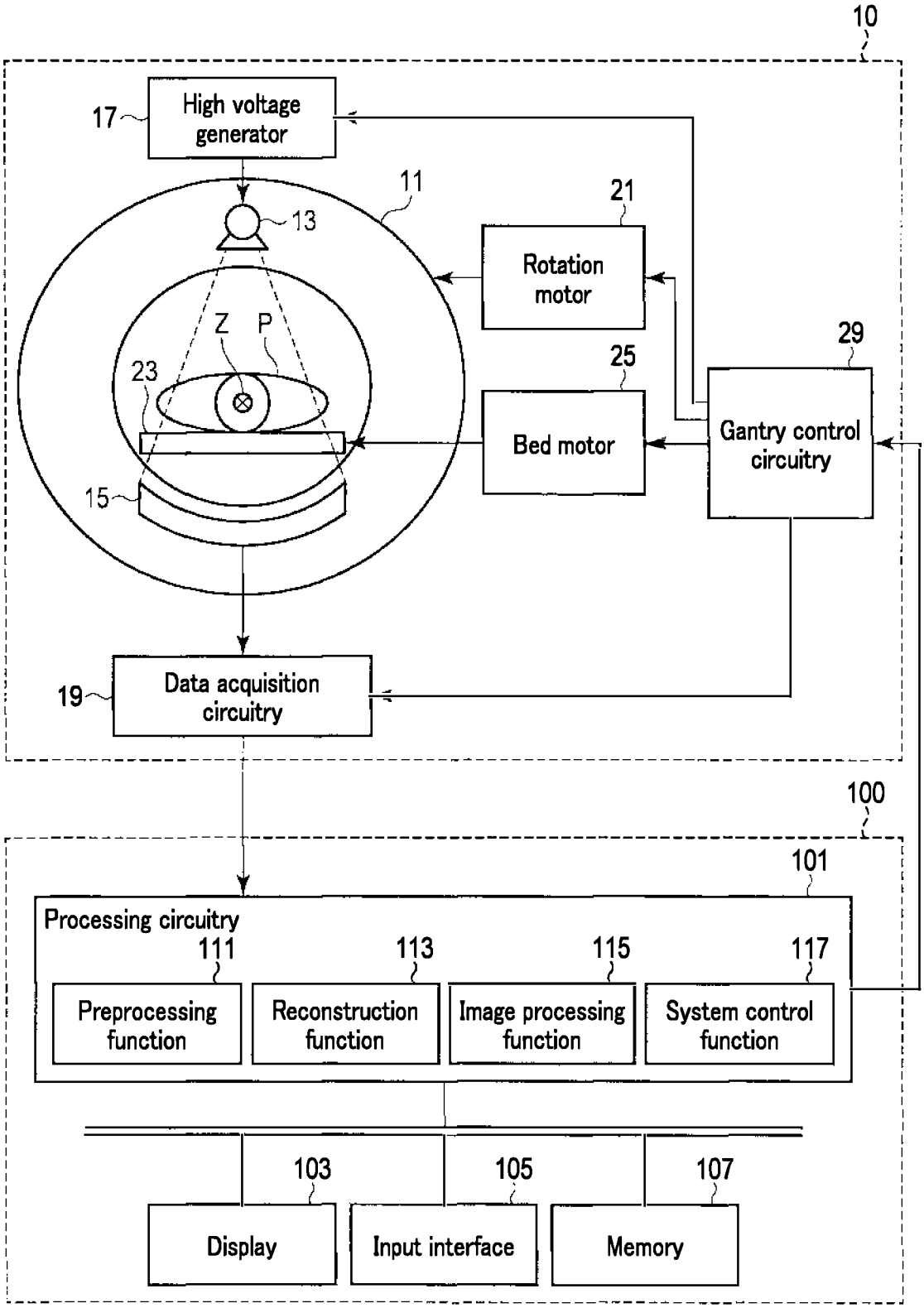
FIG. 1 illustrates the configuration of the X-ray computed tomography apparatus according to the present embodiment.

FIG. 1 illustrates the configuration of the X-ray computed tomography apparatus according to the present embodiment. As shown in FIG. 1, the X-ray computed tomography apparatus of the present embodiment includes a gantry 10 and a console 100. For example, the gantry 10 is placed in a CT examination room, and the console 100 is placed in a control room adjacent to the CT examination room. The gantry 10 and the console 100 are communicatably connected to each other. The gantry 10 includes an imaging mechanism configured to perform X-ray CT imaging of a subject P. The console 100 is a computer that controls the gantry 10.

As shown in FIG. 1, the gantry 10 includes a rotation frame 11 of an essentially cylindrical shape, which includes a bore. The rotation frame 11 is also referred to as a rotation unit. As shown in FIG. 1, an X-ray tube 13 and an X-ray detector 15 which are arranged to face each other via the bore are attached to the rotation frame 11. The rotation frame 11 is a metal frame made, for example, of aluminum, in an annular shape. As will be explained below, the gantry 10 includes a main frame made of metal, such as aluminum. The main frame is also referred to as a stationary unit. The rotation frame 11 is rotatably supported by the main frame.

The X-ray tube 13 generates X-rays. The X-ray tube 13 is a vacuum tube which holds a cathode that generates thermoelectrons and an anode that generates X-rays by receiving the thermoelectrons that have traveled from the cathode. The X-ray tube 13 is connected to an X-ray high voltage device 17 via a high voltage cable.

The X-ray high voltage device 17 may adopt any type of high voltage generator such as a transformer type X-ray high voltage generator, a constant voltage type X-ray high voltage generator, a capacitor type X-ray high voltage generator, or an inverter type X-ray high voltage generator. The X-ray high voltage device 17 is attached, for example, to the rotation frame 11. The X-ray high voltage device 17 adjusts a tube voltage applied to the X-ray tube 13, a tube current, and the focus size of the X-rays in accordance with control by a gantry control circuitry 29. The X-ray high voltage device 17 according to the present embodiment discretionarily adjusts the X-ray focus of the X-ray tube 13. The X-ray high voltage device 17 performs tube voltage modulation to modulate a tube voltage while X-rays are applied. During the period when the tube voltage modulation is performed, the X-ray high voltage device 17 can discretionarily adjust the X-ray focus of the X-ray tube 13. The details about the X-ray tube 13 and the X-ray high voltage device 17 will be described below.

As shown in FIG. 1, the rotation frame 11 rotates about a center axis Z at a predetermined angular velocity upon receiving power from a rotation motor 21. The rotation motor 21 may be any motor such as a direct drive motor, a servo motor, etc. The rotation motor 21 is housed, for example, in the gantry 10. The rotation motor 21 generates power to rotate the rotation frame 11 upon receiving a driving signal from the gantry control circuitry 29.

An FOV is set in the bore of the rotation frame 11. A top plate supported by a bed 23 is inserted into the bore of the rotation frame 11. The subject P is placed on the top plate. The bed 23 movably supports the top plate. A bed motor 25 is housed in the bed 23. The bed motor 25 generates power to move the top plate in the longitudinal direction, the vertical direction, and the widthwise direction upon receiving a driving signal from the gantry control circuitry 29. The bed 23 regulates the top plate so that an imaging target portion of the subject P is included within the FOV.

The X-ray detector 15 detects the X-rays generated by the X-ray tube 13. Specifically, the X-ray detector 15 includes a plurality of detection elements arranged on a two-dimensional curved surface. The X-ray detection elements each include a scintillator and a photoelectric conversion element. The scintillator is formed of a material that converts X-rays into photons. The scintillator converts the applied X-rays into photons of a number corresponding to the intensity of the applied X-rays. The photoelectric conversion element is a circuit element that amplifies photons received from the scintillator and converts the received photons into an electrical signal. For example, a photomultiplier tube or a photodiode, etc. is applied as the photoelectric conversion element. The detection elements may adopt an indirect conversion type detection element that converts X-rays into photons and then detects the photons, or a direct conversion type detection element that directly converts X-rays into an electrical signal.

The X-ray detector 15 is connected to data acquisition circuitry 19. In accordance with the instruction from the gantry control circuitry 29, the data acquisition circuitry 19 reads from the X-ray detector 15 an electrical signal corresponding to the intensity of X-rays detected by the X-ray detector 15, and acquires raw data having a digital value corresponding to the dose of X-rays during a view period. The data acquisition circuitry 19 is implemented by, for example, an ASIC (Application Specific Integrated Circuit) on which a circuit element that is capable of generating raw data is mounted.

As shown in FIG. 1, the gantry control circuitry 29 synchronously controls the X-ray high voltage device 17, the data acquisition circuitry 19, the rotation motor 21, and the bed motor 25, to perform X-ray CT imaging in accordance with imaging conditions obtained from the processing circuitry 101 of the console 100. The gantry control circuitry 29 includes a processor, such as a CPU (Central Processing Unit) and an MPU (Micro Processing Unit), etc. and a memory, such as a ROM (Read Only Memory) and a RAM (Random Access Memory), etc. as hardware resources. The gantry control circuitry 29 may be implemented by an ASIC or an FPGA (Field Programmable Gate Array), a CPLD (Complex Programmable Logic Device), or an SPLD (Simple Programmable Logic Device).

As shown in FIG. 1, the console 100 includes the processing circuitry 101, a display 103, an input interface 105, and a memory 107. Data communication is performed between the processing circuitry 101, the display 103, the input interface 105, and the memory 107 via a bus.

The processing circuitry 101 includes a processor such as a CPU, an MPU, or a GPU (Graphics Processing Unit), etc. as hardware resources. The processing circuitry 101 executes various programs to implement a preprocessing function 111, a reconstruction function 113, an image processing function 115, and a system control function 117. The preprocessing function 111, the reconstruction function 113, the image processing function 115, and the system control function 117 may be implemented by the processing circuitry 101 on a single substrate, or may be implemented by the processing circuitry 101 on a plurality of substrates.

By the preprocessing function 111, the processing circuitry 101 performs preprocessing such as logarithmic conversion to raw data transmitted from the gantry 10. The preprocessed raw data is also referred to as projection data.

By the reconstruction function 113, the processing circuitry 101 generates a CT image representing a space distribution of CT values relating to the subject P based on the preprocessed raw data. The known image reconstruction algorithm such as an FBP (Filtered Back Projection) method or a successive approximation reconstruction method, may be adopted.

By the image processing function 115, the processing circuitry 101 performs various image processing to a CT image reconstructed by the reconstruction function 113. For example, the processing circuitry 101 performs three-dimensional image processing, such as volume rendering, surface volume rendering, image value projection processing, MPR (Multi-Planer Reconstruction) processing, CPR (Curved MPR) processing, etc. to the CT image to generate a display image.

By the system control function 117, the processing circuitry 101 integrally controls the X-ray computed tomography apparatus according to the present embodiment. Specifically, the processing circuitry 101 reads a control program stored in the memory 107, deploys the control program, and controls the respective units of the X-ray computed tomography apparatus in accordance with the deployed control program.

The display 103 displays various data, such as a CT image, etc. For example, a CRT display, a liquid crystal display, an organic EL display, an LED display, a plasma display, or any other display known in this technical field may be adopted as the display 103.

The input interface 105 accepts various instructions from a user. Specifically, the input interface 105 includes an input device. The input device receives various instructions from a user. A keyboard, a mouse, or switches etc. may be used as the input device. The input interface 105 supplies an output signal from the input device to the processing circuitry 101 via a bus.

The memory 107 is a storage device such as a RAM, a ROM, an HDD, an SSD, or an integrated circuit storage unit, etc., configured to store various kinds of information. The memory 107 may be a drive, etc. configured to read and write various kinds of information with respect to a portable storage medium such as a CD-ROM drive, a DVD drive, or a flash memory, etc. For example, the memory 107 stores a control program, etc. relating to CT imaging according to the present embodiment.

Figure 2:
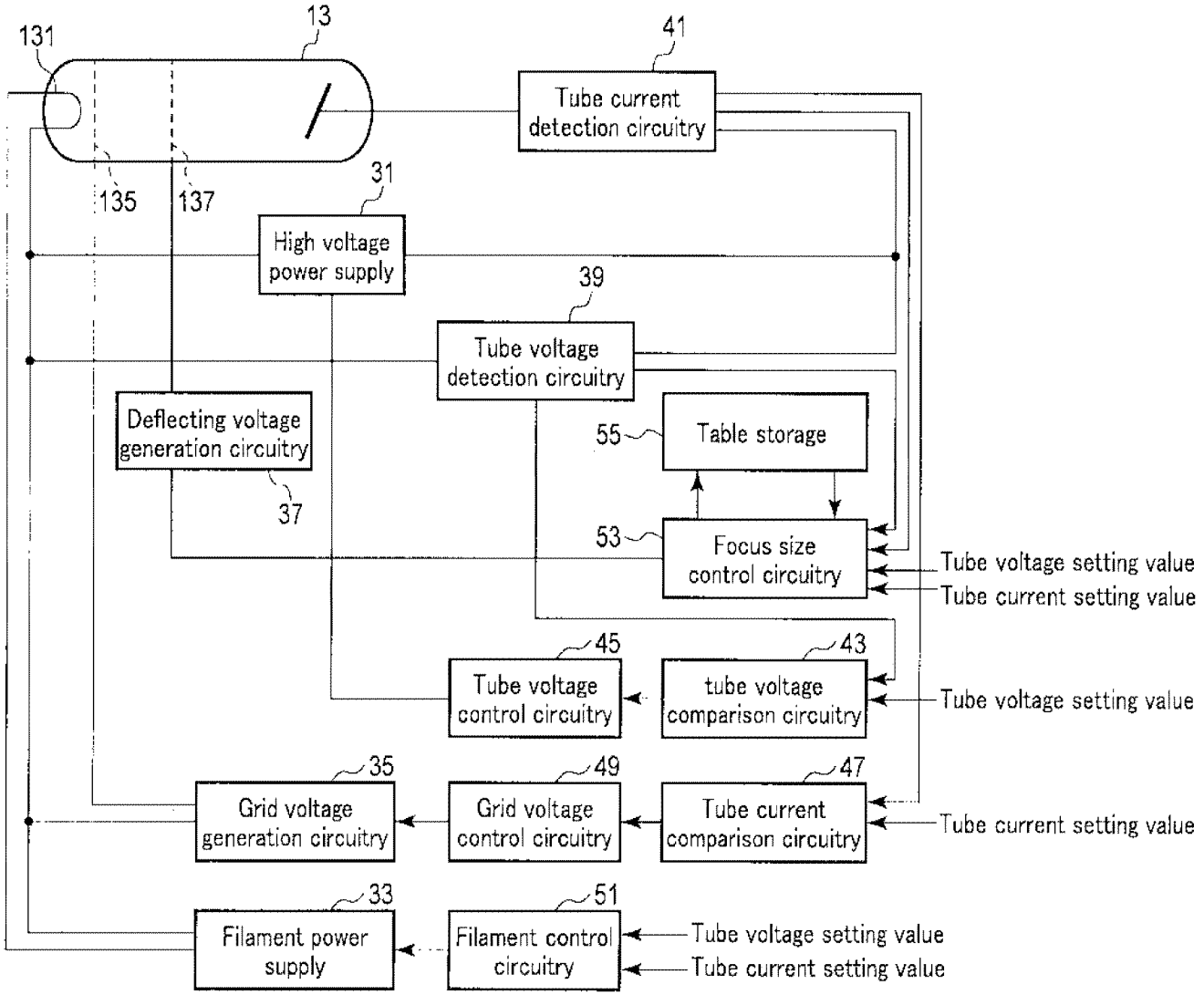
FIG. 2 illustrates the configuration of an X-ray generation system that includes an X-ray tube and an X-ray high voltage device according to the present embodiment.
Figures 3, 4:
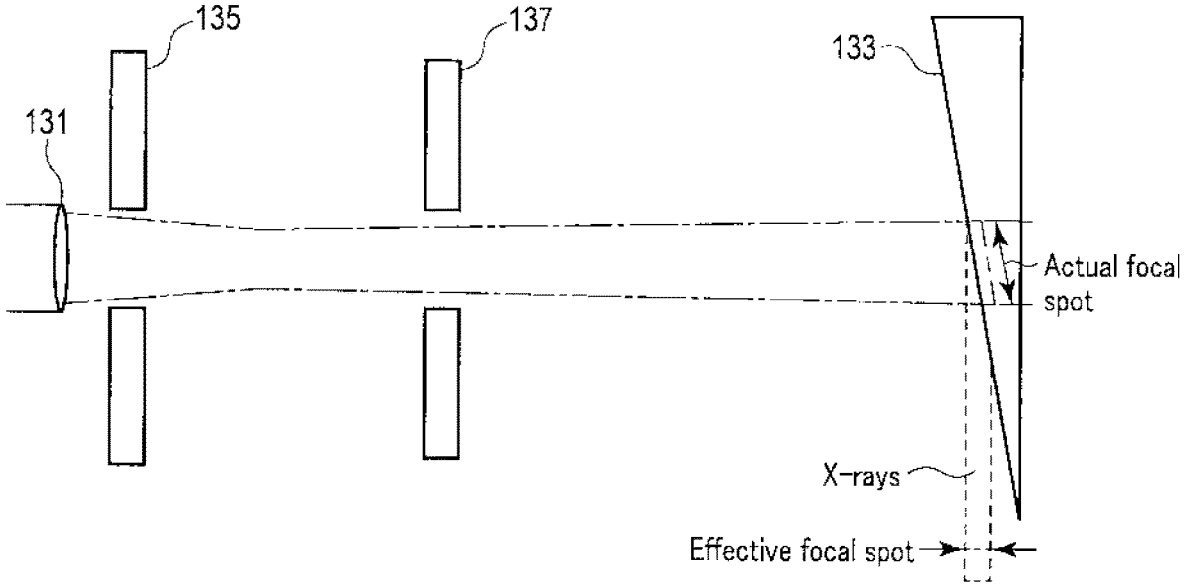
FIG. 3 illustrates the internal configuration of the X-ray tube shown in FIG. 2.
FIG. 4 is an example of an X-ray tube characteristics value table stored in a table storage shown in FIG. 2.

Next, an X-ray generation system that includes the X-ray tube 13 and the X-ray high voltage device 17 according to the present embodiment will be explained. FIG. 2 illustrates the configuration of the X-ray generation system that includes the X-ray tube 13 and the X-ray high voltage device 17 according to the present embodiment. The X-ray tube 13 shown in FIG. 2 is an anode grounded type. The X-ray tube 13 according to the present embodiment is not limited to the anode grounded type, but may be any type such as a mid-point grounded type. FIG. 3 illustrates the internal configuration of the X-ray tube 13.

As shown in FIGS. 2 and 3, the X-ray tube 13 houses a cathode 131, an anode 133, a grid electrode 135, and a deflector 137. The cathode 131 has a filament made of metal such as tungsten, nickel, etc. in a narrow linear shape. The cathode 131 is connected to the X-ray high voltage device 17 via a cable, etc. The cathode 131 generates heat and emits thermoelectrons upon supplement of a filament current and application of a cathode voltage from the X-ray high voltage device 17.

The anode 133 is an electrode made of a heavy metal such as tungsten or molybdenum in a disc shape. The anode 133 rotates in accordance with rotation about its axis of a rotor not shown in the drawings. The X-ray high voltage device 17 applies a high voltage between the cathode 131 and the anode 133. The thermoelectrons emitted from the cathode 131 by the tube voltage collide with the anode 133. The anode 133 generates X-rays upon receiving the thermoelectrons. An area of the anode 133 upon which the thermoelectrons collide is referred to as an actual focal spot, and an apparent focal spot from the X-ray detector side is referred to as an effective focal spot. In the case where the actual focal spot and the effective focal spot are not distinguished, they are referred simply as a focus.

The grid electrode 135 is arranged between the cathode 131 and the anode 133. The X-ray high voltage device 17 applies to the grid electrode 135 a grid voltage relative to a cathode potential. The amount of thermoelectrons traveling from the cathode 131 to the anode 133 is adjusted by application of the grid voltage. Accordingly, a tube current value is discretionarily controlled.

The deflector 137 is arranged between the grid electrode 135 and the anode 133. The deflector 137 is implemented by an electrode or a coil. The X-ray high voltage device 17 applies to the deflector 137 a deflecting voltage. In the case where the deflector 137 is an electrode, the deflector 137 applies a deflecting electric field to a traveling path of thermoelectrons upon receiving an application of the deflecting voltage. In the case where the deflector 137 is a coil, the deflector 137 applies a deflecting magnetic field to a traveling path of thermoelectrons upon receiving application of the deflecting voltage. The trajectory of thermoelectrons traveling from the cathode 131 to the anode 133 is deflected by receiving application of the deflecting electric field or deflecting magnetic field. The focus size is adjusted by the above operation. The focus size is defined by a combination of a length of an effective focal spot with respect to a row direction of the X-ray detector 15 and a width of an effective focal spot with respect to a channel direction of the X-ray detector 15.

In the X-ray tube 13 shown in FIG. 2, the cathode 131, the grid electrode 135, the deflector 137, and the anode 133 are arranged in the order given. However, the present embodiment is not limited thereto. For example, the cathode 131, the deflector 137, the grid electrode 135, and the anode 133 may be arranged in this given order.

As shown in FIG. 2, the X-ray high voltage device 17 includes high voltage power supply 31, filament power supply 33, grid voltage generation circuitry 35, deflecting voltage generation circuitry 37, tube voltage detection circuitry 39, tube current detection circuitry 41, tube voltage comparison circuitry 43, tube voltage control circuitry 45, tube current comparison circuitry 47, grid voltage control circuitry 49, filament control circuitry 51, focus size control circuitry 53, and a table storage 55.

The high voltage power supply 31 generates a tube voltage to be applied to the X-ray tube 13 in accordance with control by the tube voltage control circuitry 45. For example, for an inverter type X-ray high voltage device, the high voltage power supply 31 includes an AC/DC converter that converts an AC voltage from a commercial power supply into a DC voltage, an inverter that converts the DC voltage of the AC/DC converter to an AC voltage, a transformer that steps up the AC voltage from the inverter, and high voltage rectifying and smoothing circuitry that rectifies and smoothes the AC voltage boosted by the transformer and generates a DC high voltage. The DC high voltage from the high voltage rectifying and smoothing circuitry is applied between the cathode 131 and the anode 133 of the X-ray tube 13 as a tube voltage.

The filament power supply 33 generates a filament current to heat the filament of the cathode 131, in accordance with control by the filament control circuitry 51.

The grid voltage generation circuitry 35 applies a grid voltage between the cathode 131 and the grid electrode 135 of the X-ray tube 13, in accordance with control by the grid voltage control circuitry 49. Typically, a grid voltage is applied relative to the cathode potential of the cathode 131. The grid voltage generation circuitry 35 may be implemented by step-down circuitry that steps down a voltage generated by the high voltage power supply 31, or by a power supply system independent from the high voltage power supply 31.

The deflecting voltage generation circuitry 37 applies a deflecting voltage to the deflector 137 of the X-ray tube 13 in accordance with control by the focus size control circuitry 53. The deflecting voltage generation circuitry 37 is implemented by a power supply system independent from the high voltage power supply 31. For example, the deflecting voltage generation circuitry 37 includes an AC/DC converter that converts an AC voltage from a commercial power supply into a DC voltage, an inverter that converts the DC voltage of the AC/DC converter to an AC voltage, a transformer that steps down the AC voltage from the inverter, and rectifying and smoothing circuitry that rectifies and smoothes the AC voltage stepped-down by the transformer and generates a DC voltage. The DC voltage from the rectifying and smoothing circuitry is applied to the deflector 137 as a deflecting voltage.

The tube voltage detection circuitry 39 is connected between the high voltage power supply 31 and the X-ray tube 13. The tube voltage detection circuitry 39 detects, as a tube voltage, the voltage applied between the cathode 131 and the anode 133. A signal (hereinafter referred to as a tube voltage detection signal) indicating the detected tube voltage value (hereinafter referred to as a tube voltage detection value) is supplied to the tube voltage comparison circuitry 43 and the focus size control circuitry 53.

The tube current detection circuitry 41 is connected between the high voltage power supply 31 and the X-ray tube 13. The tube current detection circuitry 41 detects, as a tube current, a current that flows due to thermoelectrons flowing from the cathode 131 to the anode 133. A signal (hereinafter referred to as a tube current detection signal) indicating the detected tube current value (hereinafter referred to as a tube current detection value) is supplied to the tube current comparison circuitry 47 and the focus size control circuitry 53.

The tube voltage comparison circuitry 43 inputs a signal indicating a setting value (hereinafter referred to as a tube voltage setting value) of the tube voltage from the gantry control circuitry 29 and a tube voltage detection signal from the tube voltage detection circuitry 39. The tube voltage comparison circuitry 43 subtracts the tube voltage detection signal from the tube voltage setting signal to generate a signal (hereinafter referred to as a differential voltage signal) indicating a differential value between the tube voltage setting value and the tube voltage detection value. The differential voltage signal is supplied to the tube voltage control circuitry 45.

The tube voltage control circuitry 45 controls the high voltage power supply 31 based on a comparison between the tube voltage detection value and the tube voltage setting value, namely, the differential voltage signal. Specifically, the tube voltage control circuitry 45 performs feedback control to the high voltage power supply 31 so that the tube voltage detection value converges to the tube voltage setting value.

The tube current comparison circuitry 47 inputs a signal (hereinafter referred to as a tube current setting signal) indicating a setting value (hereinafter referred to as a tube current setting value) of the tube current from the gantry control circuitry 29 and a tube current detection signal from the tube current detection circuitry 41. The tube current comparison circuitry 47 subtracts the tube current detection signal from the tube current setting signal to generate a signal (hereinafter referred to as a differential current signal) indicating a differential value between the tube current setting value and the tube current detection value. The differential current signal is supplied to the grid voltage control circuitry 49.

The grid voltage control circuitry 49 controls the grid voltage generation circuitry 35 based on a comparison between the tube current detection value and the tube current setting value, namely, the differential current signal. Specifically, the grid voltage control circuitry 49 performs feedback control to the grid voltage generation circuitry 35 so that the tube current detection value converges to the tube current setting value.

The filament control circuitry 51 generates a signal (hereinafter referred to as a filament current setting signal) indicating a setting value of a filament current based on the tube voltage setting signal, the tube current setting signal, and focus size information from the gantry control circuitry 29, and controls the filament power supply 33 in accordance with the filament current setting signal. The tube current is controlled, for example, by control of the filament current by the filament control circuitry 51. When performing the tube voltage modulation, the tube current may be controlled by control of the filament current by the filament control circuitry 51 and control of the grid voltage by the grid voltage control circuitry 49. The tube current cannot match with the modulated tube voltage merely by the control of the filament current, and accordingly, the matching delay is compensated by the control of the grid voltage. The focus size information is information indicating a desired focus size selected, for example, by the input interface 105. The focus size information is supplied from the gantry control circuitry 29.

The focus size control circuitry 52 controls the size of a focus formed in the anode 133 by applying to the deflector 137 a deflecting voltage of a deflecting voltage value based on a tube voltage value of the tube voltage and a predetermined size, in order to form a focus of the predetermined size in the anode 133 during the period where the tube voltage is applied between the cathode 131 and the anode 133 by the high voltage power supply 31. For example, the focus size control circuitry 53 controls the size of a focus formed in the anode 133 based on a deflecting voltage value associated with a tube voltage value of the tube voltage in the table storage 55, in order to form a focus of a predetermined size in the anode 133 during the period where the tube voltage is modulated. Specifically, the focus size control circuitry 53 inputs the tube voltage detection signal, the tube current detection signal, the tube voltage setting value, and the tube current setting value. The focus size control circuitry 53 inputs to the table storage 55 at least one of a tube voltage detection value indicated by a tube voltage detection signal or a tube voltage setting value indicated by a tube voltage setting signal, and determines a deflecting voltage value required for forming the focus of the predetermined size. The focus size control circuitry 53 may determine a deflecting voltage value based on at least one of a tube current detection value indicated by a tube current detection signal or a tube current setting value indicated by a tube current setting signal, in addition to the tube voltage value. The focus size control circuitry 53 controls the deflecting voltage generation circuitry 37 to apply a deflecting voltage of the determined deflecting voltage value to the deflector 137.

The table storage 55 stores a plurality of tube voltage values and deflecting voltage values, the tube voltage values being associated with the respective deflecting voltage values to be applied to the deflector 137 in order to form a focus of a predetermined size in the anode 133. In the case where a deflecting voltage is determined in consideration of a tube current value, the table storage 55 stores a plurality of tube voltage values, tube current values, and deflecting voltage values, and the combinations of a tube voltage value and a tube current value are associated with the respective deflecting voltage values. In the following description, it is assumed that a deflecting voltage value is determined based on a tube voltage value and a tube current value. The table storage 55 stores an LUT (Look Up Table) in which the relationships between the combinations of a tube voltage value and a tube current value and the respective deflecting voltage values are defined for each of a plurality of focus sizes. In the following description, the LUT is referred to as an X-ray tube characteristics value table.

FIG. 4 illustrates an example of the X-ray tube characteristics value table. As shown in FIG. 4, a deflecting voltage value is associated with each of the combinations of an input value to the X-ray tube characteristics value table and a set focus size [length mm×width mm]. An input value is defined by a combination of an input tube voltage value [kV] and an input tube current value [mA]. A tube voltage setting value or a tube voltage detection value is input as an input tube voltage value. A tube current setting value or a tube current detection value is input as an input tube current value. The input tube voltage values vary by increments of 1 kV, and the input tube current values vary by increments of 1 mA. The set focus size is set, for example, through the input interface 105 by a user. The deflecting voltage value is a deflecting voltage value to be applied to the deflector 137 to realize the set focus size in the case where a load defined by a particular combination of an input tube voltage value and an input tube current value is applied to the X-ray tube 13. For example, in the case where an input tube voltage value, "V1", and an input tube current value, "A11", are applied to the X-ray tube 13, a deflecting voltage value, "BV111" is required to be applied to the deflector 137, in order to realize the set focus size, "L1×W1".

The focus size control circuitry 52 may control a focus size during a period where the tube voltage is constant, which is where the tube voltage is not modulated by the tube voltage control circuitry 45, or control a focus size during a period where the tube voltage is modulated by the tube voltage control circuitry 45, if the focus size can be adjusted to a certain selected value under a condition where the tube voltage is applied. In the following description, it is assumed that the focus size control circuitry 52 controls the size of a focus formed in the anode 133 by applying to the deflector 137 a deflecting voltage of a deflecting voltage value based on a tube voltage value of the modulated tube voltage and a predetermined size, in order to form a focus of the predetermined size in the anode 133 during the period where the tube voltage is modulated by the tube voltage control circuitry 45.

Next, an example of the operation of the X-ray computed tomography apparatus, relating to control of a tube current and a focus size in tube voltage modulation will be explained.

Figure 5:
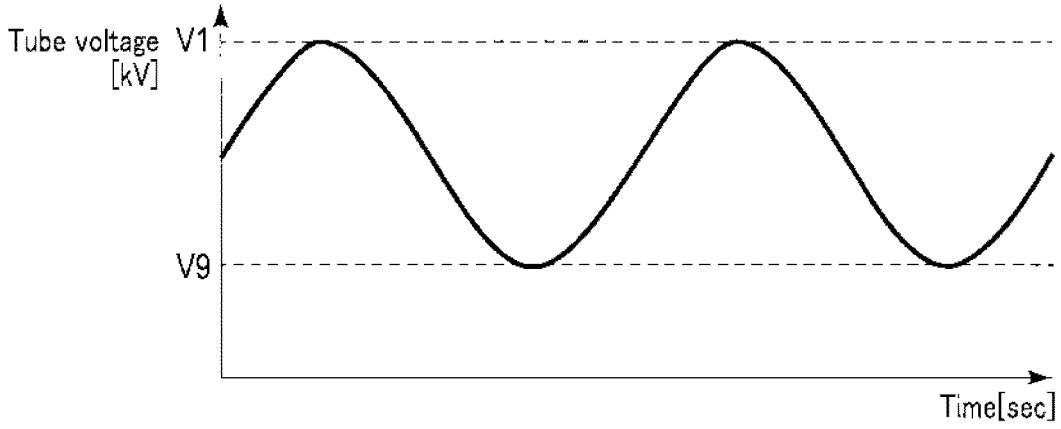
FIG. 5 illustrates a graph of tube voltage setting values in tube voltage modulation according to the present embodiment.

FIG. 5 illustrates a graph of tube voltage setting values in tube voltage modulation. In the graph of FIG. 5, the ordinate defines the tube voltage [kV], and the abscissa defines time [sec]. As shown in FIG. 5, the tube voltage varies cyclically so that the upper limit value V1 and the lower limit value V9 alternate each other in the tube voltage modulation. The upper limit value V1 and the lower limit value V9 may be any values.

The tube voltage control circuitry 45 controls the high voltage power supply 31 to vary the tube voltage value so that the upper limit value V1 and the lower limit value V9 cyclically alternate as shown in FIG. 5. The tube voltage modulation is performed as described below, for example. The tube voltage comparison circuitry 43 inputs from the gantry control circuitry 29 a waveform of tube voltage setting values exhibiting alternate repetition of the upper limit value V1 and the lower limit value V9 as shown in FIG. 5 during X-ray imaging. The tube voltage comparison circuitry 43 immediately inputs a tube voltage detection value which is an output relative to the tube voltage setting value from the tube voltage detection circuitry 39. The tube voltage comparison circuitry 43 calculates a differential value (tube voltage differential value) between the tube voltage setting value and the tube voltage detection value, and repeatedly feeds back the calculated tube voltage differential value to the tube voltage control circuitry 45, while performing the tube voltage modulation. The tube voltage control circuitry 45 controls the high voltage power supply 31 in accordance with the tube voltage differential value to apply a voltage between the cathode 131 and the anode 133 in order for the tube voltage detection value to be equal to the tube voltage setting value. By this operation, the tube voltage modulation can be performed in accordance with the tube voltage setting value.

Next, the tube current control will be explained. If the tube voltage is modulated, the amount of thermoelectrons emitted from the cathode 131, namely, the tube current is also changed due to the emission characteristics of filament of the cathode 131. The grid voltage control circuitry 49 adjusts the amount of thermoelectrons emitted from the cathode 131 by applying a grid voltage to the cathode potential to discretionarily control the tube current value.

Specifically, the tube current comparison circuitry 47 calculates a differential value (tube current differential value) between the tube current setting value and the tube current detection value, and repeatedly feeds back the calculated tube current differential value to the grid voltage control circuitry 49, while performing the tube voltage modulation. The grid voltage control circuitry 49 repeatedly controls the grid voltage generation circuitry 35 in accordance with the tube current differential value so that the tube current detection value becomes equal to the tube current setting value. The grid voltage generation circuitry 35 repeatedly applies a grid voltage in accordance with the tube current differential value between the cathode 131 and the grid electrode 135. By repeatedly adjusting the grid voltage, the tube current detection value can be maintained to be the tube current setting value. For example, in the case where the tube current setting value is a constant value that does not vary over time, the grid voltage control circuitry 49 can maintain the tube current value to be the constant value during the tube voltage modulation.

Figure 6:
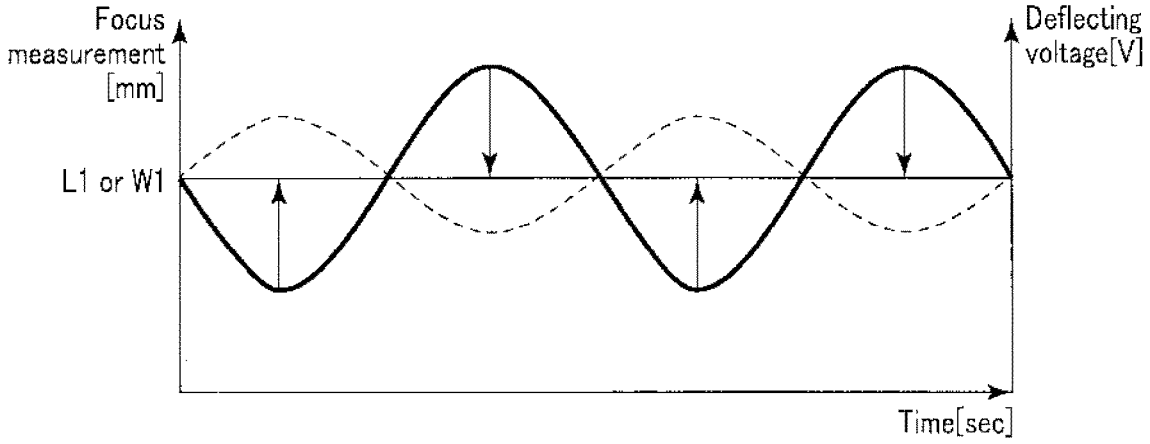
FIG. 6 illustrates a graph of focus sizes and deflecting voltages in accordance with the tube voltage modulation according to the present embodiment.

Next, the focus size control will be explained. FIG. 6 illustrates a graph of focus measurements and deflecting voltages in accordance with the tube voltage modulation. The focus measurement is a generic term of a length and a width of a focus. The focus measurement is a measurement in one direction of a length or a width. The focus size is a combination of the measurements in two directions of a length and a width. A length and a width are independently controlled by the focus size control circuitry 53. The focus size is modulated in accordance with modulation of the focus measurement.

In the graph of FIG. 6, the left ordinate represents a focus measurement [length mm or width mm], the right ordinate represents a deflecting voltage [V], and the abscissa represents time [sec]. The left ordinate of FIG. 6 is one-dimensional, and cannot represent a focus size, which is two-dimensional. Accordingly, for simplification of the explanation, the left ordinate is assumed to represent a focus measurement. In FIG. 6, a wide line and a narrow line indicate a focus measurement, and a dotted line indicates a deflecting voltage. As indicated by the wide line of FIG. 6, in the case where tube voltage modulation is simply performed, the focus measurement changes in accordance with the tube voltage modulation, and accordingly, the image quality is deteriorated. The focus size control circuitry 53 according to the present embodiment utilizes the X-ray tube characteristics value table and controls the deflecting voltage generation circuitry 37 so that a constant focus measurement can be maintained regardless of application of the tube voltage modulation, as indicated by the narrow line of FIG. 6.

The method of focus size control may be a method using a tube voltage detection value and a tube current detection value, and a method using a tube voltage setting value and a tube current setting value. The methods will be described below.

In the method using a tube voltage detection value and a tube current detection value, the focus size control circuitry 53 inputs a set focus size from the gantry control circuitry 29 at the time of initiating X-ray CT imaging. The set focus size is assumed to be a constant value that does not vary over time. For example, as shown in FIG. 6, the set focus size is set as "L1×W1", etc. During X-ray CT imaging, the focus size control circuitry 53 repeatedly receives a feedback of the tube voltage detection value from the tube voltage detection circuitry 39 and a feedback of the tube current detection value from the tube current detection circuitry 41.

During X-ray CT imaging, the focus size control circuitry 53 searches for the X-ray tube characteristics value table by using the tube voltage detection value and the tube current detection value as search keys in predetermined intervals, and specifies a deflecting voltage value that is associated with the combination of the set focus size, the tube voltage detection value and the tube current detection value. For example, as shown in FIG. 4, in the case where the set focus size is "L1 or W1", the tube voltage detection value is "V2", and the tube current detection value is "A21", the deflecting voltage value "BV211" is specified. The focus size control circuitry 53 controls the deflecting voltage generation circuitry 37 to apply a deflecting voltage of the specified deflecting voltage value to the deflector 137 every time a deflecting voltage is specified. Since the deflecting voltage generation circuitry 37 generates a deflecting voltage by a power supply system independent from the high voltage power supply 31, the focus size control circuitry 53 can control the deflecting voltage independently from the tube voltage. Accordingly, by applying to the deflector 137 the deflecting voltage of the deflecting voltage value determined by using the X-ray tube characteristics value table, the focus size can be maintained to be the set focus size even in the case where the tube voltage is modulated.

In the method using a tube voltage setting value and a tube current setting value, the focus size control circuitry 53 inputs a set focus size from the gantry control circuitry 29 at the time of initiating X-ray CT imaging. The focus size control circuitry 53 inputs a tube voltage setting value and a tube current setting value from the gantry control circuitry 29 during the X-ray CT imaging. The tube voltage setting value relating to the tube voltage modulation varies cyclically over time, as shown in FIG. 5. The tube current setting value and the set focus size are assumed to be a constant value that does not vary over time.

During X-ray CT imaging, the focus size control circuitry 53 searches for the X-ray tube characteristics value table by using the set focus size, the tube voltage setting value and the tube current setting value as search keys in predetermined intervals, and specifies a deflecting voltage value that is associated with the combination of the set focus size, the tube voltage setting value and the tube current setting value. The focus size control circuitry 53 controls the deflecting voltage generation circuitry 37 to apply a deflecting voltage of the specified deflecting voltage value to the deflector 137 every time a deflecting voltage is specified. Accordingly, by applying to the deflector 137 the deflecting voltage of the deflecting voltage value determined by using the X-ray tube characteristics value table, the focus size can be maintained to be the set focus size even in the case where the tube voltage is modulated.

The different X-ray tube characteristics value tables may be used for the method using a tube voltage detection value and a tube current detection value and the method using a tube voltage setting value and a tube current setting value. That is, a first X-ray tube characteristics value table in which a tube voltage detection value and a tube current detection value are set as input values, and a second X-ray tube characteristics value table in which a tube voltage setting value and a tube current setting value are set as input values may be generated and stored in the table storage 55. In this case, a deflecting voltage value associated with a particular input value in the first X-ray tube characteristics value table may be different from a deflecting voltage value associated with the same input value in the second X-ray tube characteristics value table. This is because the tube voltage setting value is not always equal to the tube voltage detection value detected in response to application of a tube voltage due to response delay, etc.

In the case where the tube voltage setting value and the tube current setting value are used, a deflecting voltage value in which a response delay amount of a tube voltage or a tube current relative to the setting value is taken into account may be registered in the X-ray tube characteristics value table.

In the aforementioned embodiment, the focus size is assumed to be maintained to a constant value during the tube voltage modulation. However, the present embodiment is not limited thereto. That is, the set focus size may cyclically alternate between a first size and a second size over time. Even in this case, the focus size control circuitry 53 can determine a deflecting voltage value by referring to the X-ray tube characteristics value table based on the combination of the set focus size, tube voltage setting value, and tube current setting value upon receiving a waveform of the cyclically alternating set focus size as an input. Accordingly, the focus size control circuitry 53 can control the focus size to be any values when performing tube voltage modulation.

The focus size control circuitry 53 is assumed to control the deflector 137 to realize the set focus size based on the combination of a tube voltage value and a tube current value. However, the present embodiment is not limited thereto. For example, the focus size control circuitry 53 is assumed to control the deflecting voltage generation circuitry 37 to realize the set focus size based on a tube voltage value or a tube current value. In this case, a tube voltage value or a tube current value is associated with a deflecting voltage value for each of the set focus sizes in the X-ray tube characteristics value table. The focus size control circuitry 53 searches for the X-ray tube characteristics value table by using a combination of a tube voltage value or a tube current value and a set focus size as search keys to specify a deflecting voltage value associated with the combination, and controls the deflecting voltage generation circuitry 37 in accordance with the specified deflecting voltage value. By this operation, the focus size can be discretionarily controlled based on any one of a tube voltage value or a tube current value.

In the aforementioned embodiment, the focus size control circuitry 53 is assumed to determine a deflecting voltage value by referring to the X-ray tube characteristics value table. However, the present embodiment is not limited thereto. For example, the focus size control circuitry 53 may calculate a deflecting voltage value corresponding to an input tube voltage value and a set focus size or a deflecting voltage value corresponding to a combination of an input tube voltage value and an input tube current value and a set focus size, in accordance with a predetermined algorithm, or may determine such a deflecting voltage value by machine learning, etc.

According to at least one of the aforementioned embodiments, the focus size can be discretionarily controlled.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An X-ray computed tomography apparatus comprising:

an X-ray tube comprising a cathode configured to emit electrons, an anode configured to generate X-rays upon receiving the electrons from the cathode, a deflector configured to deflect the electrons from the cathode, and a grid electrode configured to adjust an amount of electrons traveling from the cathode to the anode;

a power supply configured to generate a tube voltage applied between the cathode and the anode; and a tube voltage controller configured to modulate the tube voltage;

grid voltage control circuitry configured to control the amount of electrons traveling from the cathode to the anode by applying to the grid electrode a grid voltage in accordance with a difference between a tube current value and a setting value, in order to maintain the tube current value to the setting value, the tube current value being the tube current flowing to the X-ray tube during a period where the tube voltage is modulated by the tube voltage controller; and focus size control circuitry configured to control a size of a focus formed in the anode by applying to the deflector a deflecting voltage of a deflecting voltage value based on a tube voltage value of the tube voltage and a predetermined size, in order to form a focus of the predetermined size in the anode during a period where the tube voltage is modulated by the tube voltage controller.

* * * * *